US006131900A

United States Patent [19]

Hou

[11] Patent Number: 6,131,900

[45] Date of Patent: Oct. 17, 2000

[54] SHEETS STACKING SYSTEM WITH DISK TYPE INVERTER-STACKER AT RIGHT ANGLE TO PRINTER OUTPUT

[75] Inventor: Ssujan Hou, Cheshire, Conn.

[73] Assignee: Xerox Corporation, Stamford, Conn.

[21] Appl. No.: 09/409,435

[22] Filed: Sep. 30, 1999

[51] Int. Cl.[7] ..... B65H 29/00

[52] U.S. Cl. ..... 271/184; 271/187

[58] Field of Search ..... 271/187, 186, 271/184, 225

[56] References Cited

U.S. PATENT DOCUMENTS

| | | | |
|---|---|---|---|
| 4,733,857 | 3/1988 | Feldeisen | 271/296 |
| 5,145,167 | 9/1992 | McGraw et al. | 271/186 |
| 5,261,655 | 11/1993 | Keller et al. | 271/187 |
| 5,503,386 | 4/1996 | Straessler et al. | 271/184 X |
| 5,518,230 | 5/1996 | Scarlatz et al. | 271/187 X |
| 5,842,695 | 12/1998 | McVeigh | 271/187 |

*Primary Examiner*—David H. Bollinger

[57] ABSTRACT

A printed sheets output inverting and stacking system for printers printing normal size sheets oriented widthwise and long size sheets oriented lengthwise, with a disk type rotatable sheet inverting and stacking system positioned adjacent to one side of the printer output path with its axis of rotation parallel to the direction of sheet movement of the printer. A scuffer or other lateral sheet feeding system receives the printed sheet output of the printer and laterally moves each sheet towards one side of the printer output path, at right angles to the original direction of sheet movement, and into the sheet inverting slots of the rotatable disk inverter-stacker, so that the long size sheets are inverted widthwise, for increased stacking reliability.

5 Claims, 2 Drawing Sheets

Figure 1:
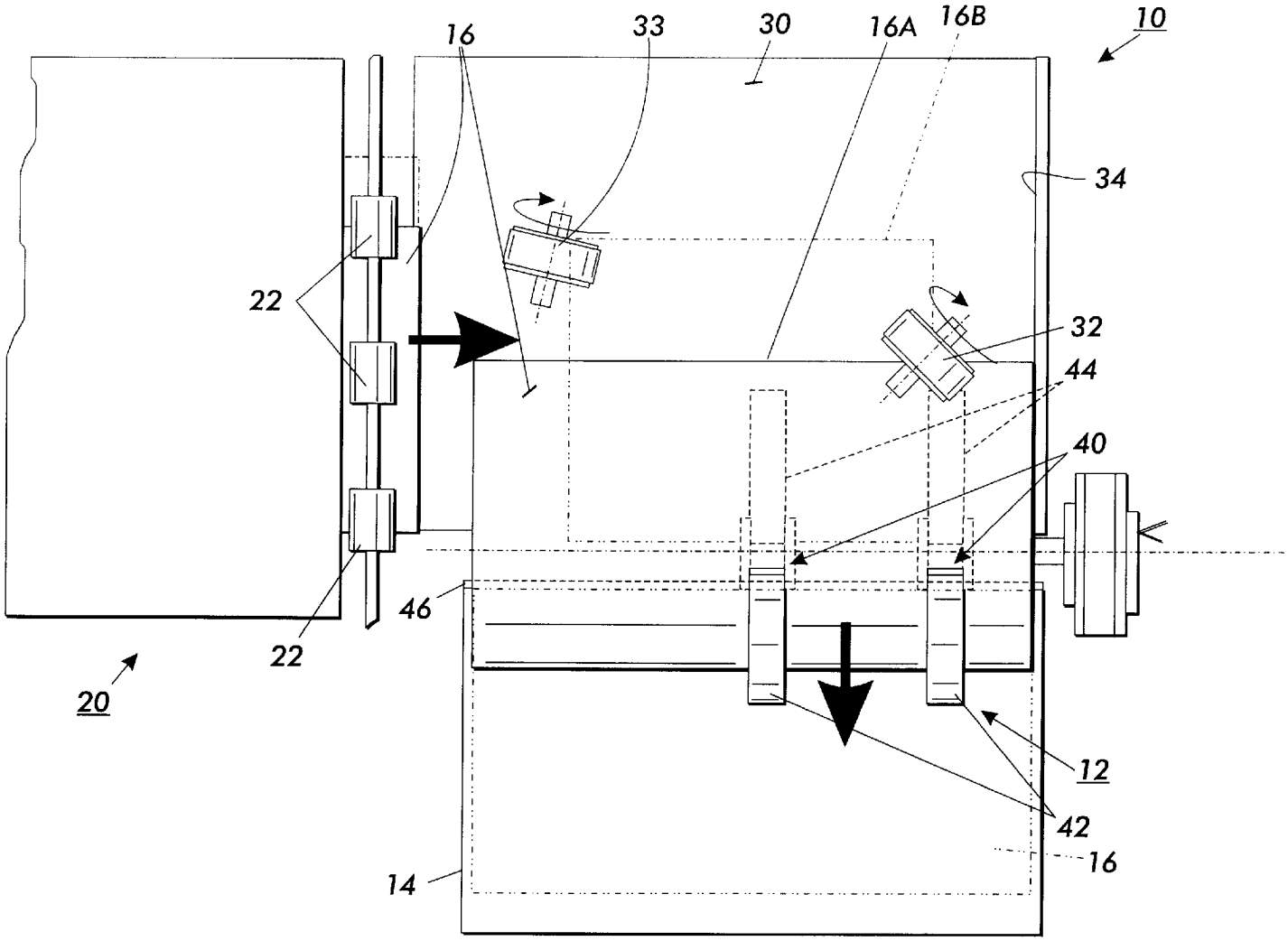

SHEETS STACKING SYSTEM WITH DISK TYPE INVERTER-STACKER AT RIGHT ANGLE TO PRINTER OUTPUT

Disclosed in the embodiment herein is an improved sheet stacking system for the stacking of printed sheets of different sheet sizes being outputted by a printer, including large sheets, utilizing an inverter-stacker. In the disclosed embodiment, long sheets are outputted by the printer lengthwise, but inverted and stacked sideways by the inverter-stacker. This provides improves substantially more reliable sheet stacking of such longer sheets. It can be provided even with known, conventional disk-type inverter-stackers by inverting and stacking all of the printer outputted sheets at right angles to the output path of the printer, from one side of the output path.

The disclosed system is particularly suitable for any of the various known commercial printers which feed and print standard sizes of sheets and smaller sheets widthwise, but which feed and print longer sheets lengthwise. This is due to well known conflicting goals for a printing machine. It is desired on one hand to have a paper path width limitation for machines so as not to make the machine too wide, but on the other hand higher printing speeds, more sheets per minute, can be obtained by feeding and printing paper width-wise whenever possible.

It will be understood that the term "printer", as used herein, encompasses various reproduction apparatus, especially xerographic printers or copiers, for printing or imaging on typical print media, such as flimsy paper or plastic sheets in the various standard copy sheet sizes (letter, legal, A4, B4, ledger, 11"×17", etc).

The disclosed system is simple and low cost, yet overcomes serious problems with the proper stacking of long sheets in an inverter-stacker system, especially those which are thin, limp or otherwise have low beam-strength sheets. Typical long and flimsy printed sheets have stacking problems when being outputted, inverted, and stacked lengthwise. Typical such long sheets include U.S. 11"×17" sheets of normal or light paper weights, or European A3 size short grain paper sheets. It is known in the art that such large and flimsy sheets can have stacking failures in a disk-type inverter-stacker system when the trail end area of the long sheet collapses back down over the preceding leading portion of the sheet in the output tray to form a loop thereon rather than rolling out fully onto the stacking tray to lay flat thereon. Such sheet miss-stacking can prevent the stacking of the subsequent sheets being outputted to the inverter-stacker from a printer or copier, and cause jams.

By way of relevant background, some prior patents specifically addressing those well known long sheet stacking problems, by modifications or additions to disk type inverter-stackers, include Xerox Corp. U.S. Pat. No. 5,842,695 issued Dec. 1, 1998 to Daniel J. McVeigh, with sheet corrugating fingers; and U.S. Pat. No. 5,145,167 issued Sept. 8, 1992 to Thomas C. McGraw, et al., with an overlying transport belt system assisting the trail edge flipping over movement of long sheets being inverted and stacked. The present system does not require those modifications of the disk inverter-stacker. However, they can be additionally provided, for additional stacking reliability, if desired.

Another example of a modern disk type inverter-stacker in general is Xerox Corp. U.S. Pat. No. 5,409,201 issued Apr. 25, 1995 to William E. Kramer. It also shows integral set stapling. Also, Xerox Corp. U.S. Pat. No. 5,409,202 issued Apr. 25, 1995 to Raymond A. Naramore and William E. Kramer. The theory, operation, and advantages of such disk type sheet inverting and stacking systems are well known from the above and other references, and other art cited therein, and need not be repeated in detail herein. However, they are briefly discussed further below.

It is important to note that, in contrast to the system disclosed herein, all of the above-cited disk type inverter-stacker systems are directly in the sheet path from the printer, and have an axis of rotation transverse, extending across, the sheet output path of the printer, so that the printer output feeds sheets directly, linearly, into the disk fingers of the disk inverter-stacker. Thus, the sheets stack in the same direction as the sheets are being outputted by the printer in those prior systems, the disk inverter-stacker increases the length of the overall or combined printing and stacking unit, and usually requires unloading the stacked sheets sideways or from one side end of the combined unit.

In a typical disk type inverter-stacker, as shown and described in the cited and other references, printed copy sheets are sequentially fed from the printer or copier (IOT) output straight on into the sheet entrance of the disk-type inverter-stacker, which may comprise a modular finisher output unit. Typically in such disk type output units, plural spaced rotatable semi-cylindrical disks have, or define, fingers forming arcuate sheet receiving slots. The entrances to these slots are normally initially positioned at the top of the output unit so that the lead edge of the next incoming sheet may be fed into these disk slots. The disk slots temporarily hold at least the leading edge area of the sheet within the slots for the inversion and stacking of that sheet as the disks are centrally rotated. When the disks, with these fingers and slots, have all been commonly rotated on their central shaft by approximately 180 degrees, the lead edge of the sheet in the slots has been inverted and engages a registration stripping surface edge or fingers positioned under the disk unit. That strips the sheets out from the disk slots as the disks continue to rotate, and frees that now inverted sheet for stacking onto an associated output stacking tray.

Such a disk type inverting and stacking system presupposes that the remainder (the trailing area) of a long sheet which does not fully fit into the disk slots will be flipped over to fall out flat on the stacking tray from this same rotational movement of its leading area in the slots. However, as noted above, this may not always occur with a sufficiently lengthy and flimsy sheet of paper. The printer or copier, which has necessarily continued to feed the long sheet out after the lead edge of this sheet has already been fed fully into the disk slots to the end of the disk slots, can form a large loop of the trailing area portion of the long sheet which is now hanging down over the tray, as illustrated in FIG. 3 of the above-cited U.S. Pat. No. 5,842,695. When the lead edge of this long sheet is released from the disk fingers, that loop should roll out slowly onto the tray. However, instead, it may, as illustrated in the stacking failure example of FIG. 4 of that same U.S. Pat. No. 5,842,695 cause the trail end area of the sheet to fall down directly onto the front area of the stack instead. In that stacking failure mode the long sheet forms a loop on top of the stack, rather than a laid out sheet. That is, the trail end of the large sheet collapses onto the upstream portion of the stack, onto the front portion of that same sheet, to cause a stacking failure, as shown, which prevents further proper stacking or finishing, and typically results in a jam which can cause or required a printing stoppage.

The disclosed system can overcome the above and other stacking problems for such large and flimsy sheets for many typical printers.

Further by way of background, output stacker modules with inverters, such as disk type inverter-stackers, are particularly useful, for example, for accepting sheets from a printer desirably printed face-up in forward or 1 to N serial page order, for stacking those sheets face-down, so as to provide properly collated output sets, i.e., printed output documents in proper 1 to N order when picked up from the output tray. Or, for duplex printed sheets in which the second or even page sides are printed face down. The inverter-stacker may also be part of a print job output system providing another selectable but non-inverting output stacking tray, to provide a selection between face up or face down stacking for different printing modes and/or to avoid having to use or provide an internal sheet inverter within the printer. An internal sheet inverter is usually more difficult to clear sheets from, in the event of a machine jam, than an easily externally accessible disk-type stacker unit.

It will also be noted that in disk type inverter-stackers the fingers defining the sheet transporting slots can be integral the outer edges of the rotating disks and define a slot therebetween, or be pivotally mounted thereto and have slots defined within the pivotal fingers.

The specific embodiment disclosed herein desirably does not need or require a separate sheet rotator for printers of the type described above, i.e., printers which already print and output long sheets oriented differently than (at ninety degrees to) standard size or smaller sheets. However, various means of copy sheet rotation before or at the printer output could be used with other printers. Suitable sheet rotators are well known, and need not be disclosed in detail herein. Xerox Corp. U.S. patents on 90 degree sheet rotators include U.S. Pat. Nos. 5,090,683; 4,955,965; 4,877,234; 4,733,857; 4,727,402, and other art cited therein. Printing and outputting different copy sizes of copy sheets with 90 degree different orientations of the sheets (for different reasons—transverse stacking with extending edge areas for printed banner sheets) is also taught in Xerox Corp. U.S. Pat. No. 5,316,279. Another example of printer sheet rotation (albeit for 180 degree rather than 90 degree rotation, for duplex printing) is disclosed in a Xerox Disclosure Journal publication of September/October 1984, Vol. 9, No. 5, pp. 323–324, by R. E. Shaeffer, entitled "Copy Rotator/Inverter".

By way of further background, various angled (two-axis) scuffer wheel or other diagonal or lateral sheet sifting devices are well known per se for corner registration of documents or lateral repositioning of printer output sheets being stacked, and need not be re-described in detail herein. For example, Xerox Corp. U.S. Pat. Nos. 5,120,047; 4,087,087; 4,358,197; 4,462,527; 4,621,801; 4,411,418 and 4,335,954, and other art cited therein.

Further by way of general background, in most reproduction apparatus such as xerographic and other copiers and printers or multifunction machines, it is increasingly important to provide more automatic and reliable handling of the physical image bearing sheets, especially reduced sheet jams. Especially for shared or networked printing systems in which the sheet printing and outputting may be unattended, at a remote printer. A remote printer's sheet jams may well be unobserved, and not readily cleared to avoid printer stoppages, unless and until an operator is remotely electronically notified by the system and arrives at the remote printer location.

A specific feature of the specific embodiment disclosed herein is to provide in a printed sheets output inverting and stacking system for a printer, which printer provides an output of normal size printed sheets oriented widthwise, and an output of long size sheets oriented lengthwise, sequentially in a printer output path having a first direction of sheet movement; wherein said printer output inverting and stacking system comprises a rotatable sheet inverting and stacking system rotatable about an axis of rotation, said sheet inverting and stacking system having sheet retaining and transporting slots for receiving therein, and inverting by said rotation about said axis of rotation, said printed sheets output of said printer, the improvement wherein: said rotatable sheet inverting and stacking system is positioned adjacent to one side of said printer output path with said axis of rotation parallel to said first direction of sheet movement; and wherein there is a lateral sheet feeding system operatively positioned in said printer output path between said printer output and said rotatable sheet inverting and stacking system for sequentially receiving said printed sheets output of said printer and laterally moving said printed sheets output of said printer towards one side of said printer output path in a second direction of sheet movement at right angles to said first direction of sheet movement and into said sheet retaining and transporting slots of said rotatable sheet inverting and stacking system, so that said long size sheets are inverted widthwise in said rotatable sheet inverting and stacking system for increased reliability, and said normal size printed sheets are inverted lengthwise in said rotatable sheet inverting and stacking system.

Further specific features disclosed herein, individually or in combination, include those wherein said lateral sheet feeding system comprises at least one angled sheet scuffer system; and/or wherein said lateral sheet feeding system includes a sheet lead edge registration stop transverse said first direction of sheet movement; and/or wherein said lateral sheet feeding system includes a sheet lead edge registration stop transverse said first direction of sheet movement and aligned with a operative end of said rotatable sheet inverting and stacking system; and/or wherein said printer output path first direction of sheet movement is transverse the front of said printer yet said rotatable sheet inverting and stacking system stacks said sheets towards the front of said printer.

In the description herein the term "sheet" refers to a usually flimsy physical sheet of paper, plastic, or other suitable physical substrate for images, whether precut or initially web fed and cut into sheets internally. A "copy sheet" may be abbreviated as a "copy", or called a "hard-copy". A "job" or "print job" is normally a set of related sheets, usually a collated copy set copied from a set of original document sheets or electronic document page images, from a particular user, or otherwise related.

As to specific components of the subject apparatus, or alternatives therefor, it will be appreciated that, as is normally the case, some such components are known per se in other apparatus or applications which may be additionally or alternatively used herein, including those from cited art. All references cited in this specification, and their references, are incorporated by reference herein where appropriate for appropriate teachings of additional or alternative details, features, and/or technical background. What is well known to those skilled in the art need not be described here.

Figure 2:
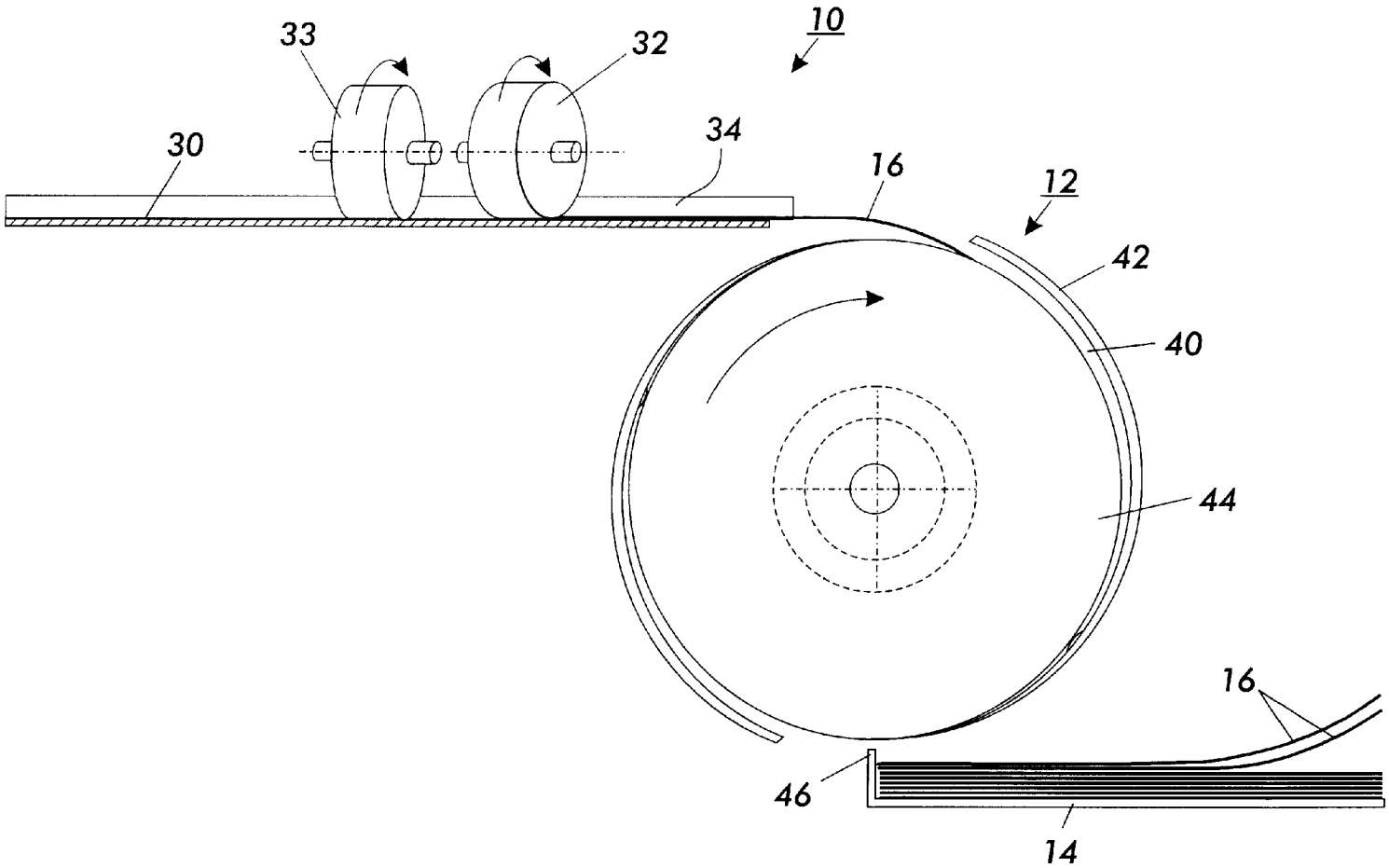

Various of the above-mentioned and further features and advantages will be apparent from the specific exemplary apparatus and its operation described in the example below. Thus, the present invention may be better understood from this description of a specific embodiment, including the drawing figures (approximately to scale) wherein:

FIG. 1 is a top view of one embodiment of the disclosed system, simplified or schematized for clarity, showing only the sheet output rollers of the sheet output path of a conventional printer, with a large flimsy sheet shown about to be inverted and stacked in a disk type inverter-stacker unit, which here is oriented at ninety degrees to the printer output path and at one side thereof, and with an exemplary conventional frictional scuffer roll and skew plate for front edge registration and lateral movement into the slots of the disk inverter-stacker; and FIG. 2 is a front view of the embodiment of FIG. 1, shown partially in cross-section, with a sheet being laterally fed by the scuffer roll into the slots of the disk inverter-stacker (shown schematically).

Describing now in further detail with reference to these figures the exemplary sheet output inverting and stacking system 10 embodiment, there is schematically shown an otherwise known disk-type inverter stacker output unit 12, like that shown in the above-cited patents thereon, for inverting and stacking in an associated sheet stacking tray 14 the sheets 16 being sequentially outputted by a printer 20 of the type previously described. That is, a printer 20 which prints and feeds out defined standard sizes of sheets (such as letter size and legal size or smaller sheets) widthwise, but which automatically prints and feeds out sheets of a defined longer length (including U.S. 11"×17" sheets in particular) lengthwise, for the reasons explained above. In the xerographic printing arts these two ninety degree different sheet feeding orientations, widthwise and lengthwise, are more usually respectively referred to as feeding the sheets "long edge first" and "short edge first" in the "process direction". The printer 20 is merely one example of any of various such reproduction machines with which the present system may be utilized, and hence only its output is shown, specifically, the output rollers 22 in FIG. 1. The printed sheets 16 are inverted and stacked by the inverter-stacker unit 12 as previously described above and/or in the cited references. The unit 12 may also include jogging or tamping and stapling or other set finishing, as also described in those patents, if desired.

Specifically, all of the printed copy sheets 16, including (as shown in the top view of FIG. 1) a long flimsy 11"×17" sheet 16A, are sequentially fed from the printer 20 output 22 in their normal process and output movement direction, shown by the associated sheet movement arrow. (A normal letter size sheet 16B is also shown fed out here in FIG. 1, but in phantom, for comparison, since obviously only one sheet at a time is fed out of the printer 20.)

In this system 10, instead of printed sheets being fed directly from the printer output into the sheet entrance of a disk-type inverter-stacker output unit in the output path of the printer, the sheets are all first fed into a baffled skew plate area 30, with a sheet lead edge registration stop wall 34, where the incoming sheet are all reoriented and laterally moved by a conventional angularly driven frictional scuffer roll 32 imparting a lateral or sideways movement towards the disk inverter-stacker unit 12, with registration along the registration wall 34. That is, the scuffer roll 32 acquires each entering sheet and moves it laterally along a path defined by wall 34 into the then-adjacent entrances of the slots 40 of the fingers 42 of the rotatable disks 44 of the inverter-stacker unit 12. For more positive feed-in for small sheets, an auxiliary scuffer such as 33 in FIG. 1 may be provided. This and various other suitable such lateral sheet feeding systems for providing such a relatively small ninety degree or right angle sheet movement, transverse to the output movement direction of the sheet as it exits the printer, are taught in the references cited thereon in the above introduction.

The disk finger slots 40 temporarily hold at least the leading edge area of the sheet within the slots 40 for the sheet inversion, which is accomplished by automatically rotating the disks 44 approximately 180 degrees. As discussed in the introduction and the cited references, this rotates the lead edge area of the sheet therein around by that same amount, until the sheet lead edge engages a registration edge or fingers 46 under the disk unit 12, which strips the sheet out from the disk slots as the disks 44 continue to rotate. The rest of the now substantially inverted sheet then falls and stacks neatly onto the underlying output stacking tray 14. The spacing between the disks is of course conventionally less than the smallest sheet to be handled. Also, as shown, the registration wall 34 aligns the lead edge of all incoming sheets to be adjacent to one end of the disk inverter-stacker 12, and hence laterally aligns the sheets to the disks and finger slots.

Because of the above-described and illustration operation of the system 10, long sheets, such as 11"×17" size sheets, desirably printed and outputted lengthwise (short edge first) by the printer 20, are inverted and stacked sideways (long edge first). Thus, in the disk inverter-stacker unit 12, the dimension of the 11"×17" size sheets being inverted and stacked is their 11" dimension instead of their 17" inch long (jam prone) dimension, as it was in previous disk inverter-stacker systems. Yet the fixed width of the printer 20 does not have to be increased, because long sheets can still be fed and printed lengthwise with the system 10.

In this simple system 10, the U.S. letter size sheets are inverted and stacked lengthwise (in their 11" dimension) instead of widthwise (as they are desirably printed and outputted by the printer 20). Likewise, U.S. legal size sheets are also inverted and stacked lengthwise (in their 14" dimension). While that may be slightly less desirable in some cases, inverting and stacking such normal 11 inch or 14 inch sheet lengths does not pose nearly the difficulties, such as sheet settling times on the stack and sheet trail end collapse or fold-over jam rates, of doing so for flimsy long sheets, such as 11"×17" size sheets. Also, for all sheets in the system 10, because of the reduced inverting length of long sheets, two sheets can be inverted and stacked in each rotation of the disk inverter-stacker with an appropriate disks 44 circumference, i.e., using both of the finger slots 40. Stack jogging or tamping may also be more effective by the stacking of the long sheets sideways.

In this system 10 all of the sheets conveniently stack towards the front of the printer 20 rather than at one side or end of the printer, as is conventional.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a printed sheets output inverting and stacking system for a printer, which printer provides an output of normal size printed sheets oriented widthwise, and an output of long size sheets oriented lengthwise, sequentially in a printer output path having a first direction of sheet movement; wherein said printer output inverting and stacking system comprises a rotatable sheet inverting and stacking system rotatable about an axis of rotation, said sheet inverting and stacking system having sheet retaining and transporting slots for receiving therein, and inverting by said rotation about said axis of rotation, said printed sheets output of said printer, the improvement wherein:

said rotatable sheet inverting and stacking system is positioned adjacent to one side of said printer output path with said axis of rotation parallel to said first direction of sheet movement;

and wherein there is a lateral sheet feeding system operatively positioned in said printer output path between said printer output and said rotatable sheet inverting and stacking system for sequentially receiving said printed sheets output of said printer and laterally moving said printed sheets output of said printer towards one side of said printer output path in a second direction of sheet movement at right angles to said first direction of sheet movement and into said sheet retaining and transporting slots of said rotatable sheet inverting and stacking system, so that said long size sheets are inverted widthwise in said rotatable sheet inverting and stacking system for increased reliability, and said normal size printed sheets are inverted lengthwise in said rotatable sheet inverting and stacking system.

2. The printed sheets output inverting and stacking system for a printer of claim 1, wherein said lateral sheet feeding system comprises at least one angled sheet scuffer system.

3. The printed sheets output inverting and stacking system for a printer of claim 1, wherein said lateral sheet feeding system includes a sheet lead edge registration stop transverse said first direction of sheet movement.

4. The printed sheets output inverting and stacking system for a printer of claim 1, wherein said lateral sheet feeding system includes a sheet lead edge registration stop transverse said first direction of sheet movement and aligned with a operative end of said rotatable sheet inverting and stacking system.

5. The printed sheets output inverting and stacking system for a printer of claim 1, wherein said printer output path first direction of sheet movement is transverse the front of said printer yet said rotatable sheet inverting and stacking system stacks said sheets towards the front of said printer.

* * * * *